US006602099B1

(12) United States Patent
Loberger et al.

(10) Patent No.: US 6,602,099 B1
(45) Date of Patent: Aug. 5, 2003

(54) VIBRATION ISOLATION SUPPORT STRUCTURE FOR A THROTTLE BODY

(75) Inventors: Wade A. Loberger, Oshkosh, WI (US); Mark D. Curtis, Hartford, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/068,073

(22) Filed: Feb. 6, 2002

(51) Int. Cl.[7] ..... B63H 1/15
(52) U.S. Cl. ..... 440/52; 114/88; 114/89
(58) Field of Search ..... 440/88, 89, 52

(56) References Cited

U.S. PATENT DOCUMENTS 4,615,398 A 10/1986 Nagashima ..... 173/162
4,894,638 A 1/1990 Flierl ..... 338/162
4,964,381 A * 10/1990 Shiozaki et al. ..... 123/73 A
5,229,671 A 7/1993 Neidhard et al. ..... 310/15
5,769,045 A 6/1998 Edwards et al. ..... 123/184
5,813,886 A 9/1998 Shomura ..... 440/1

FOREIGN PATENT DOCUMENTS

GB 2180594 A * 4/1987 ..... F02B/75/18

* cited by examiner

*Primary Examiner*—Jesus D. Sotelo
(74) *Attorney, Agent, or Firm*—William D. Lanyi

(57) ABSTRACT

An isolation mounting system is provided for the purpose of supporting a throttle body structure which is completely supported by an elastomeric support, but is held in non-contact association with an air intake manifold in order to effectively isolate the throttle body structure from vibration. This isolation protects potentially delicate components contained within a component housing that is rigidly attached to the throttle body structure.

19 Claims, 4 Drawing Sheets

VIBRATION ISOLATION SUPPORT STRUCTURE FOR A THROTTLE BODY

BACKGROUND OF THE INVENTION

1. Field of the Invention

The present invention is generally related to a throttle body support structure for an internal combustion engine and, more particularly, to an elastomeric support member that supports a throttle body of an internal combustion engine relative to an air intake manifold of the engine without direct contact between the throttle body structure and the air intake manifold.

2. Description of the Prior Art

Internal combustion engines inherently create vibration due to the internal moving components, such as pistons, connecting rods, and crankshafts. It is important that certain components, such as electronic devices and wiring connections, be protected from potential damage that can occur if those relatively delicate components are subjected to significant vibration over extended periods of time.

U.S. Pat. No. 5,813,886, which issued to Shomura on Sep. 29, 1998, describes a structure for mounting a control sensor in an outboard motor. The structure permits a reduced number of components for attaching control sensors, a high degree of freedom for laying out the parts constituting the engine, efficient wiring, further improved vibration insulating properties, and use of a throttle body employed for an engine of equipment other than an outboard motor. A discrete sensor mounting holder, as a single unit, which is composed of a vibration proof member and which holds an intake air temperature detecting sensor, and an atmospheric pressure detecting sensor, respectively, is fixed to an engine of the outboard motor, the engine being provided with a fuel injecting unit and the intake air temperature detecting sensor and the atmospheric pressure detecting sensor for controlling the fuel injecting unit.

U.S. Pat. No. 5,769,045, which issued to Edwards et al on Jun. 23, 1998, describes a modular air induction system with an isolated throttle body. The air induction system for an internal combustion engine features a throttle body and air cleaner assembly vibration-isolated from the engine by a resilient air transmitting zip tube interconnecting the throttle body with the engine air intake manifold. The zip tube flexes to isolate the throttle body from the engine vibrations and oscillations thereby eliminating a cause of throttle body fractures or looseness from its mounting. Furthermore, with such oscillation, the throttle body can be readily formed from plastics and perform long service life. With the throttle body isolated, engine generated throttle pedal vibration is eliminated. Additionally with the remote location, throttle body and throttle plate coking and icing from recirculating exhaust gases is obviated. The throttle body and air cleaner assembly is supplied as a unit to augment vehicle assembly.

U.S. Pat. No. 5,229,671, which issued to Neidhard et al on Jul. 20, 1993, describes an electromagnetic rotary actuator. In a rotary actuator with rotary slide valve for controlling a throttle cross-section, the sealing of the pneumatic and of the electrical part is improved. The shaft is supported twofold, both on this side and on the other side of the rotary slide valve. Both roller bearings are located in a one-piece housing. As a result, the tolerance-related width of the air gap between rotary slide valve and control opening is reduced, on the one hand, and, on the other hand, an isolating seal between the parts and is formed by the bearing. The rotary actuator is particularly suitable as idle-speed rotary actuator for internal combustion engines.

U.S. Pat. No. 4,894,638, which issued to Flierl et al on Jan. 16, 1990, describes a potentiometer having vibration damping means. The potentiometer for attachment to objects undergoing strong vibrations, such as the engine block of an internal combustion engine, has an outer housing which is secured to the object and an inner housing which is largely positioned inside the outer housing. The two housings are connected by at least one springy damping member, such as an O-ring made of rubber and, at the same time, they are largely uncoupled with respect to vibrations.

U.S. Pat. No. 4,615,398, which issued to Nagashima on Oct. 7, 1986, describes a throttle cushion. The throttle cushion of a portable power-driven machine has a sleeve-like elastic cushioning member fitted on the portion of a trigger engageable with a throttle valve actuating rod.

The patents described above are hereby expressly incorporated by reference in the description of the present invention.

As can be seen in the patents cited above, it is well known to those skilled in the art of internal combustion engines that certain components benefit significantly from being isolated from vibrations caused by the operation of the internal combustion engine. Some vibration isolation techniques are intended to improve the comfort of the machine operator while others are intended to protect either mechanical or electrical elements of the structure.

In certain types of internal combustion engines, electronic components are mounted directly to the throttle body of the engine for support. As an example, certain throttle body designs incorporate a motor which moves the throttle plate about its central axis in response to commands received from an engine control unit (ECU). The rotation of the throttle plate can be monitored by a rotational position sensor, such as a potentiometer or a Hall effect device. Furthermore, the relationship between the motor and the throttle plate axis typically includes a combination of gears and a return spring. The electrical components associated with the motor and potentiometer are typically connected in electrical communication with an engine control unit that is mounted at a location on the engine which is remote from the throttle body. This, in turn, requires electrical connectors for plugs to provide this electrical connection. All of these components are subject to damage or degradation if they are not protected to some degree from the vibration caused by the internal combustion engine. It would therefore be significantly beneficial if a throttle body of an engine could be mounted in such a way that it is isolated from at least some of the vibrations caused by the engine.

SUMMARY OF THE INVENTION

A marine propulsion apparatus, made in accordance with the present invention comprises an internal combustion engine having an air intake chamber, or manifold and a throttle body structure having a throttle plate supported for rotation within a cavity of the throttle body structure. It also comprises an elastomeric support member attached to the air intake chamber and to the throttle body structure to support the throttle body structure in non-contact association with the air intake chamber.

It also comprises an adapter plate attached between the internal combustion engine and the elastomeric support member. The elastomeric support member can be attached to the adapter plate by a ring which surrounds portions of the adapter plate and portions of the elastomeric support member.

The preferred embodiment of the present invention can further comprise an isolator plate attached to the throttle body structure for the purpose of captivating the portion of the elastomeric support member between the isolator plate and the throttle body structure. The elastomeric support member can be provided with a sealing lip which extends between the isolator plate and the throttle body structure for, the purpose of preventing air from flowing into the air intake chamber from between the isolator plate and the throttle body structure. The cavity of the throttle body structure is generally cylindrical and the sealing lip can be disposed in a plane which is generally perpendicular to a central axis of the generally cylindrical cavity.

The present invention can further comprise a sealing protrusion extending from the elastomeric support structure in a direction toward the throttle body structure and into a generally circular groove formed in the throttle body structure. The cavity of the throttle body structure is generally cylindrical. The sealing protrusion is generally cylindrical and coaxial with the cavity. The sealing protrusion is compressible within the groove in response to the isolator plate being rigidly attached to the throttle body structure.

In a preferred embodiment of the present invention, the internal combustion engine comprises a crankshaft which is supported for rotation about a generally vertical axis. The most common application of the internal combustion engine in this arrangement is in conjunction with an outboard motor. The present invention can further comprise a motor attached to the throttle body structure. The motor is operatively attached to a shaft of the throttle plate in order to rotate the throttle plate within the cavity of the throttle body structure. A rotational position sensor, such as a potentiometer or Hall effect device, can be attached to the throttle body structure and operatively attached to the shaft of the throttle plate in order to determine a rotational position of the shaft.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
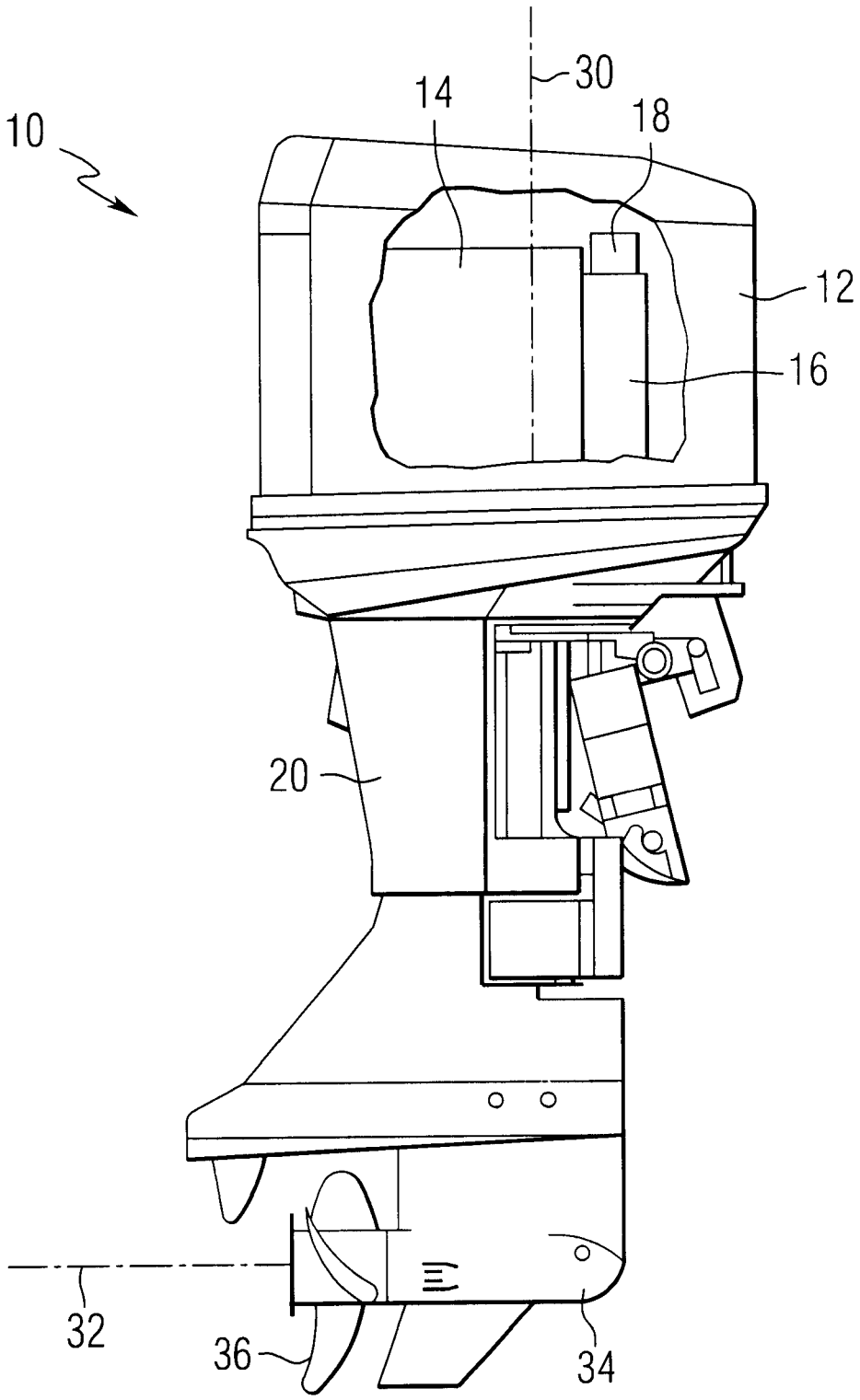
FIG. 1 shows an outboard motor and the relative positions of an internal combustion engine, an air intake manifold, and a throttle body structure.

Throughout the description of the preferred embodiment of the present invention, like components will be identified by like reference numerals.

FIG. 1 shows an outboard motor 10 with a cowl 12 under which an engine 14 is disposed. In front of the engine 14 is an air intake manifold 16 and a throttle body mechanism 18. It should be understood that the engine 14, air intake manifold 16, and throttle body 18 are depicted in a highly schematic manner in FIG. 1 for the sole purpose of showing their relative positions under the cowl 12 and not for the purpose of showing detail of those components. The throttle body 18 and air intake manifold 16 will be described and illustrated in greater detail below.

The outboard motor 10 further comprises a driveshaft housing 20 which extends downwardly from the engine. 14. Within the engine 14, a crankshaft is supported for rotation about a generally vertical axis 30. The crankshaft is attached in torque transmitting relation with a driveshaft that extends downwardly through the driveshaft housing 20 and is operatively connected to a propeller shaft which rotates about a propeller shaft axis 32 in a manner that is very well known to those skilled in the art. A right angle gearing configuration is contained within the gearcase 34 to connect the driveshaft to the propeller shaft. A propeller 36 is attached to the propeller shaft. The structure and internal components of the outboard motor 10 are very well known to those skilled in the art and will not be described in further detail.

Figure 2:
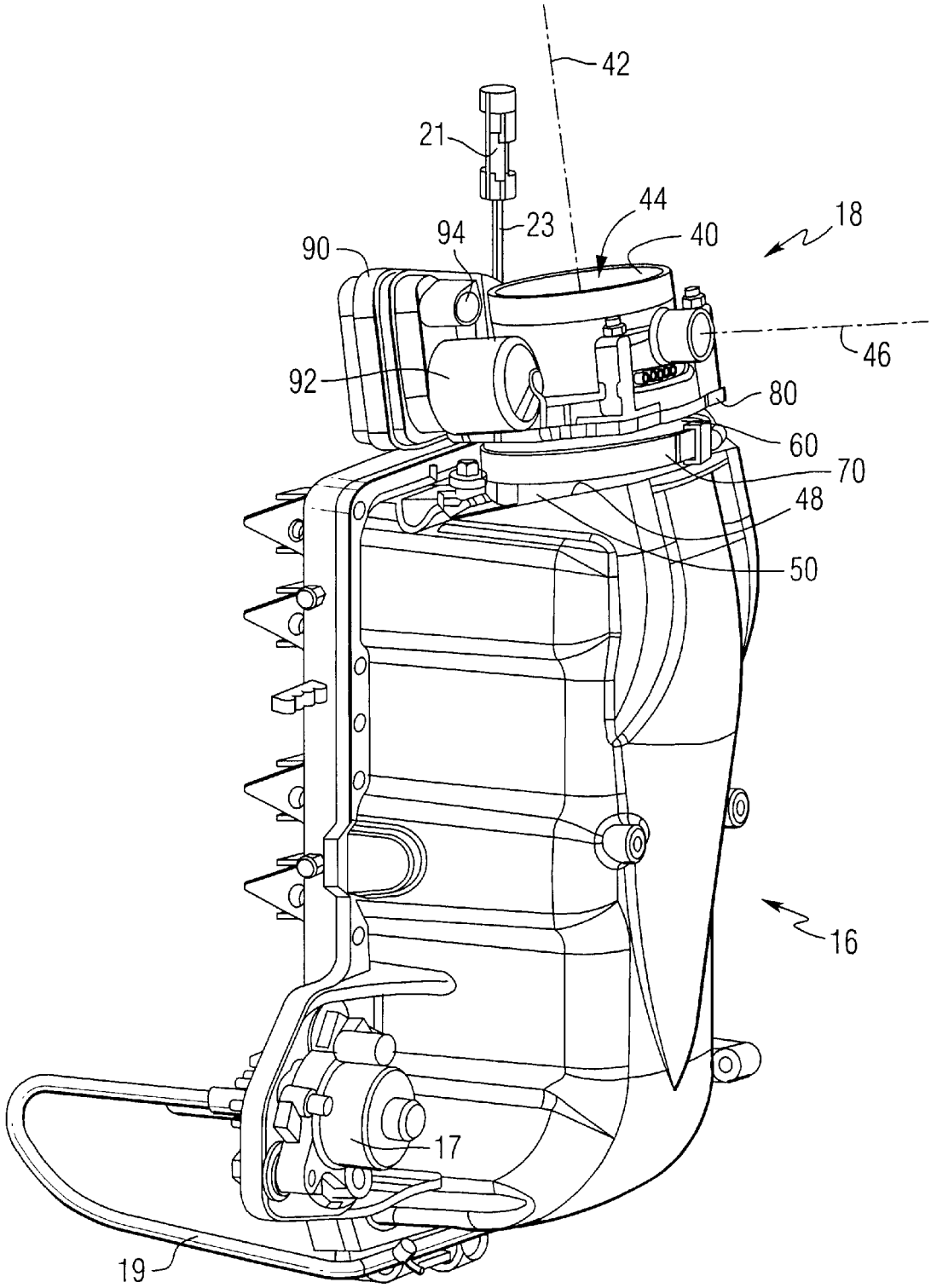
FIG. 2 is a perspective view of the air intake manifold and throttle body structure shown in FIG. 1.

FIG. 2 is a perspective view of an air intake manifold 16 and a throttle body structure 18. The throttle body structure 18 has a generally cylindrical inner surface 40. Although not shown in FIG. 2, a throttle plate (reference numeral 110 in FIG. 3) is supported within the cavity 44 of the throttle body structure 18 for rotation about a throttle axis 46.

In some applications of the present invention, the upper mounting surface of the air intake manifold 16, which is identified by reference numeral 48 in FIG. 2, is not perfectly horizontal when the outboard motor is attached to the transom of a marine vessel. An adapter plate 50 can be used to place the central axis 42 of the throttle body structure in a generally vertical configuration in these circumstances if this is desired. An elastomeric support member 60 is attached to the air intake manifold 16, in combination with the adapter plate 50. To assist in the attachment in the elastomeric support member 60 to the adapter plate 50, a ring 70, or band, is tightly attached around cylindrical portions of both the adapter plate 50 and the elastomeric support member 60.

An isolator plate 80 is attached to the throttle body structure 18 for the purpose of captivating a portion of the elastomeric support member 60 between the isolator plate 80 and the throttle body structure 18. The specific components of the present invention will be described in greater detail below in conjunction with FIG. 3.

With continued reference to FIG. 2, a component housing 90 is attached to the throttle body structure 18 for support. The component housing 90 contains a motor 92, a gear set (not shown in FIG. 2) for connecting the motor 92 in torque transmitting relation with the shaft of the throttle plate which rotates about axis 46, an electrical connector 94 which allows the component housing 90 to be connected in electrical communication with a remote engine control unit (ECU), and a rotational position sensor, such as a potentiometer or Hall effect device, for determining the rotational position of the throttle plate about its rotational axis 46. It should be understood that the precise contents of the component-housing 90 are not limiting to-the present invention, but these are components which-can benefit from vibration isolation to protect them from potential damage resulting from the vibrations that are inherent in the internal combustion engine to which the air intake manifold is rigidly attached.

The elastomeric support member 60 supports the throttle body structure 18 relative to the air intake manifold 16 without any direct contact between those two components. All of the support for the throttle body structure 18 is provided by the elastomeric support member 60 which is resilient and effective in damping vibrations and preventing those vibrations from being transmitted from the air intake manifold 16 to the throttle body structure 18.

In FIG. 2, reference numeral 17 identifies an oil pump which is not directly related to the operation of the present invention. Also, reference numeral 19 identifies an oil conduit. Reference numeral 21 identifies an electrical connector associated with a temperature sensor and reference numerals 23 identifies the electrical conductor which connects the connector 21 to the temperature sensor.

Figure 3:
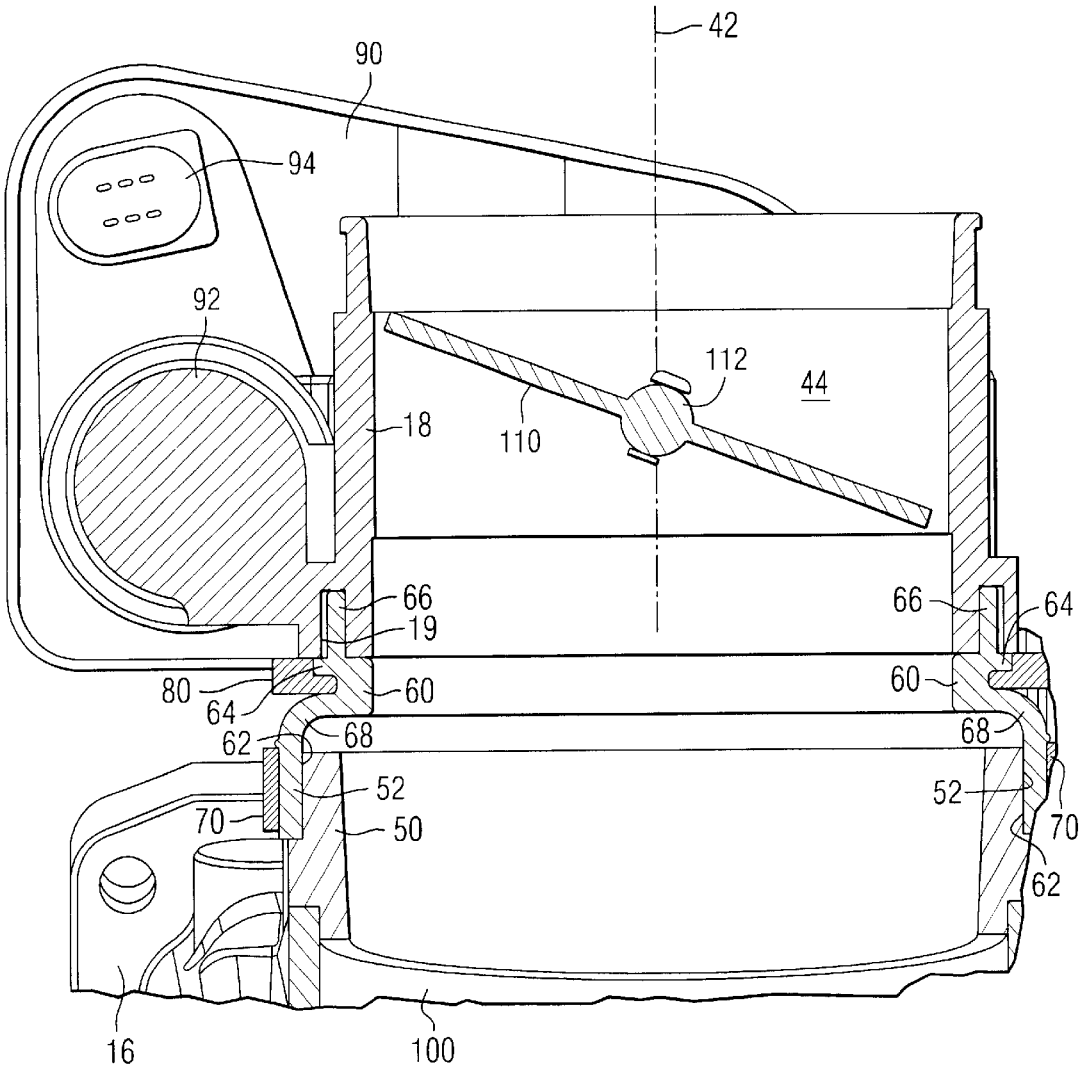
FIG. 3 is a section view of the present invention.

FIG. 3 is a section view of the present invention showing the internal chamber i 00 of the air intake manifold 16. The adapter plate 50 is shaped to have a generally cylindrical outer surface portion 52 that is shaped to receive a generally cylindrical inner surface portion 62 of the elastomeric support member 60. An Oetiker clamp 70 is disposed around these respective portions of the adapter plate 50 and elastomeric support member 60 to rigidly attach them together when the oetiker clamp is tightened.

With continued reference to FIG. 3, a throttle plate 110 is supported within the internal cavity 44 of the throttle body structure 18 and the throttle plate 110 is attached to a shaft 112 for rotation about axis 46, as described above in conjunction with FIG. 2. The motor 92 and the electrical connector 94 are shown associated with the component housing 90 which contains the associated gearing to transfer torque from the motor 92 to the shaft 112 of the throttle plate 110, a return spring, and a rotational position sensor. The rotational position of the throttle plate 110 regulates the amount of air passing downward through the cavity 44 of the throttle body structure 18. The isolator plate 80 is attachable to the throttle body structure 18, by appropriate bolts, to captivate a portion of the elastomeric support member 60 between it and the bottom surface of the throttle body structure 18. The captivated portion of the elastomeric support member can comprise a sealing lip 64 that extends in a plane that is generally perpendicular to axis 42. When the isolator plate 80 is attached to the throttle body structure 18, it exerts an upward force that is opposed by a downward force exerted by the bottom surface of the throttle body. This comprises the sealing lip 64 to, create a seal that prevents the passage of air into the cavity 44 or into the air intake manifold 16 through the interface, or space, between the upper portion of the air intake manifold 16 and the lower portion of the throttle body structure 18. The elastomeric support member 60 is also provided with a sealing protrusion 66 which is shaped to be received within a groove 19 formed in the lower surface of the throttle body structure 18. The groove 19 is shaped to receive the sealing protrusion and these two elements are sized so that the sealing protrusion 66 is compressed when the isolator plate 80 is attached to the throttle body structure 18. This provides a further sealing function to prevent air from flowing into the cavity 44 and into the air intake manifold 16 from locations external to the throttle body structure 18.

As can be seen in FIG. 3, the throttle body structure 18 is supported above the upper portion of the air intake manifold 16 in non-contact association with the air intake manifold 16. The portion of the elastomeric support member 60 which is identified by reference numeral 68 supports the throttle body structure 18 above the air intake manifold 16 and in non-contact association with it. Vibrations that are transmitted to the air intake manifold 16 from the engine 14 are damped by the portion 68 of the elastomeric support member 60 and inhibited from being transmitted to the throttle body structure 18. This, in turn, isolates the delicate components of the component housing 90, such as the potentiometer or electrical connections contained within the housing 90.

Figure 4:
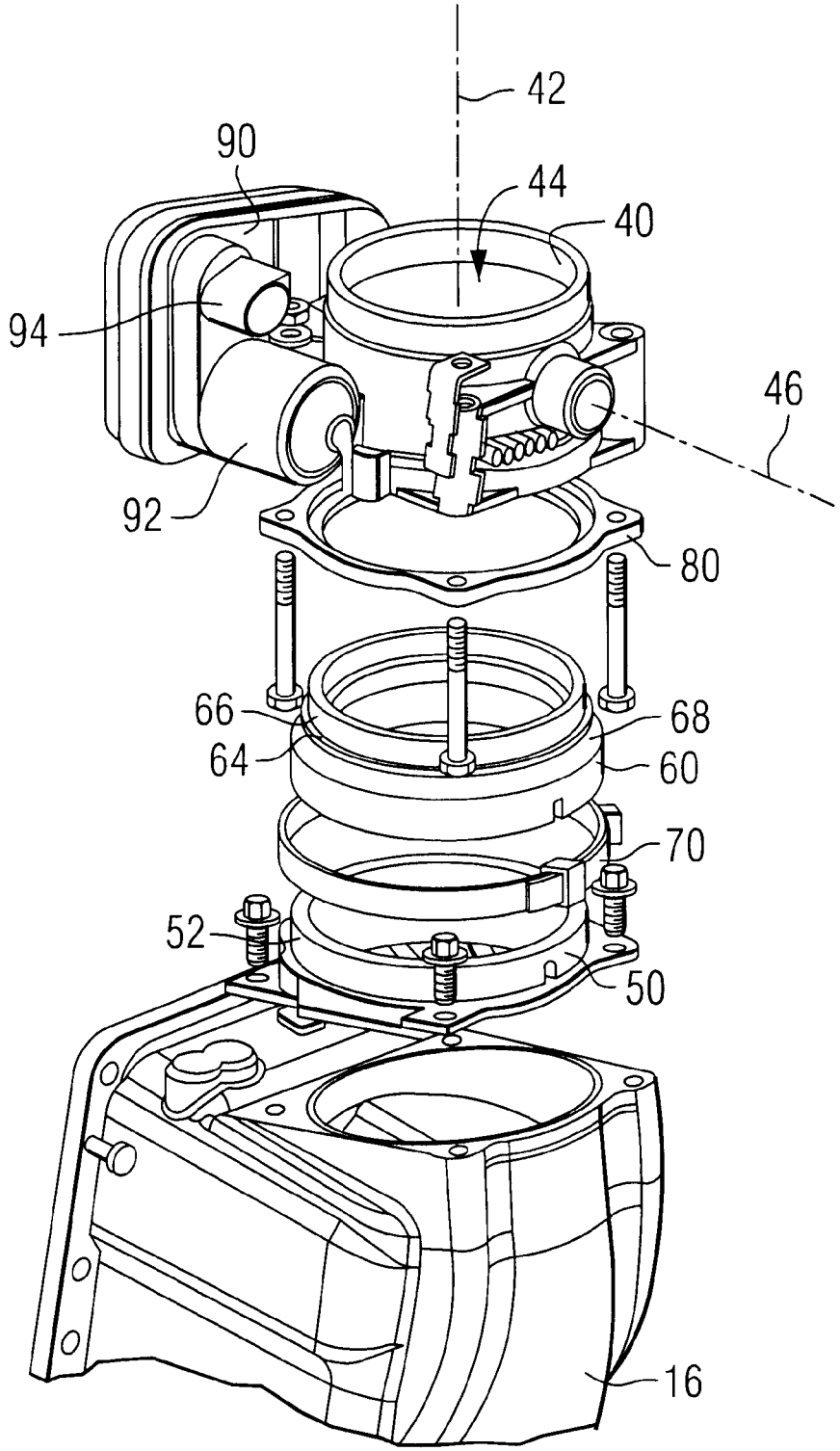
FIG. 4 is an exploded view of the components shown in FIG. 2.

FIG. 4 is an exploded view of FIG. 2. In FIG. 4, the relationship between the various components of the present invention can be seen. With reference to FIGS. 3 and 4, it can be seen that the elastomeric support member 60, in combination with the adapter plate 50, is shaped to support the throttle body structure 18 in non-contact association with the air intake manifold 16. The internal cylindrical surface 62 of the elastomeric support member 60 is shaped to be received over and around surface 52 of the adaptor plate 50. The Oetiker clamp 70 is placed around surfaces 52 and 62 to rigidly clamp the elastomeric support member 60 to the adaptor plate 50. At the upper portion of the elastomeric support member 60, the sealing lip 64 is shown disposed in a plane that is generally perpendicular to axis 42 of the generally cylindrical inner surface of the throttle body structure 18. The sealing lip 64 is shaped to be compressed between the isolator plate 80 and the lower surface of the throttle body structure 18 to create a seal. The sealing protrusion 66 is shaped to be received in the groove 19 of the throttle body structure 18 and compressed to provide a further seal when the sealing protrusion 66 is compressed. This compression results from the relative sizes of the groove 19 and the sealing protrusion 66 and the operation of the isolator plate 80 when it is rigidly attached and drawn toward the lower surface of the throttle body structure 18.

An important characteristic of the present invention is that it is shaped to support the throttle body structure 18 in non-contact association with the air intake manifold 60 because of the provision of the portion 68 of the elastomeric support structure 60.

With continued reference to FIGS. 3 and 4, it can be seen that the cavity 44 is generally cylindrical and the sealing lip 64 is disposed in a plane that is generally perpendicular to the central axis 42 of the generally cylindrical cavity 44. The sealing protrusion 66 is generally cylindrical in shape and it can also be seen that the portion 68 of the elastomeric support member 60 allows the throttle body structure 18 to move relative to the air intake manifold 16 because of the resilient nature of the elastomeric support structure 60. This isolates vibrations from being transmitted to the throttle body structure 18 and the potentially delicate components contained within the component housing 90 that is rigidly attached to the throttle body structure 18.

Although the present invention has been described in particular detail and illustrated to show a preferred embodiment, it should be understood that alternative embodiments are also within its scope.

We claim:

1. A marine propulsion apparatus, comprising:

an internal combustion engine having an air intake chamber;

a throttle body structure having a throttle plate supported for rotation within a cavity of said throttle body structure;

an elastomeric support member attached to said air intake chamber and to said throttle body structure to support said throttle body structure in non-contact association with said air intake chamber; and an adapter plate attached between said internal combustion engine and said elastomeric support member.

2. The apparatus of claim 1, wherein:

said elastomeric support member is attached to said adapter plate by a ring which surrounds portions of said adapter plate and portions of said elastomeric support member.

3. The apparatus of claim 1, further comprising:

an isolator plate attached to said throttle body structure for the purpose of captivating a portion of said elastomeric support member between said isolator plate and said throttle body structure.

4. The apparatus of claim 3, wherein:

said elastomeric support member has a sealing lip which extends between said isolator plate and said throttle body structure for the purpose of preventing air from flowing into said air intake chamber from between said isolator plate and said throttle body structure.

5. The apparatus of claim 4, wherein:

said cavity of said throttle body structure is generally cylindrical and said sealing lip is disposed in a plane which is generally perpendicular to a central axis of said generally cylindrical cavity.

6. The apparatus of claim 1, further comprising:

a sealing protrusion extending from said elastomeric support structure in a direction toward said throttle body structure and into a generally circular groove formed in said throttle body structure.

7. The apparatus of claim 6, wherein:

said cavity of said throttle body structure is generally cylindrical, said sealing protrusion being generally cylindrical and coaxial with said cavity.

8. The apparatus of claim 6, wherein: said sealing protrusion is compressible within said groove in response to said isolator plate being rigidly attached to said throttle body structure.

9. The apparatus of claim 1, wherein:

said internal combustion engine comprises a crank shaft which is supported for rotation about a generally vertical axis.

10. The apparatus of claim 1, further comprising:

a motor attached to said throttle body structure, said motor being operatively attached to a shaft of said throttle plate to rotate said throttle plate within said cavity of said throttle body structure.

11. The apparatus of claim 10, further comprising:

a rotational position sensor attached to said throttle body structure and operatively attached to said shaft of said throttle plate to determine a rotational position of said shaft.

12. A marine propulsion apparatus, comprising:

an internal combustion engine having an air intake chamber;

a throttle body structure having a throttle plate supported for rotation within a cavity of said throttle body structure;

an elastomeric support member attached to said air intake chamber and to said throttle body structure to support said throttle body structure in non-contact association with said air intake chamber; and an isolator plate attached to said throttle body structure for the purpose of captivating a portion of said elastomeric support member between said isolator plate and said throttle body structure, said elastomeric support member having a sealing lip which extends between said isolator plate and said throttle body structure for the purpose of preventing air from flowing into said air intake chamber from between said isolator plate and said throttle body structure.

13. The apparatus of claim 12, further comprising:

an adapter plate attached between said internal combustion engine and said elastomeric support member, said elastomeric support member being attached to said adapter plate by a ring which surrounds portions of said adapter plate and portions of said elastomeric support member, said cavity of said throttle body structure being generally cylindrical and said sealing lip being disposed in a plane which is generally perpendicular to a central axis of said generally cylindrical cavity.

14. The apparatus of claim 13, further comprising:

a sealing protrusion extending from said elastomeric support structure in a direction toward said throttle body structure and into a generally circular groove formed in said throttle body structure, said sealing protrusion being generally cylindrical and coaxial with said cavity, said sealing protrusion being compressible within said groove in response to said isolator plate being rigidly attached to said throttle body structure.

15. The apparatus of claim 14, wherein:

said internal combustion engine-comprises a crank shaft which is supported for rotation about a generally vertical axis.

16. The apparatus of claim 15, further comprising:

a motor attached to said throttle body structure, said motor being operatively attached to a shaft of said throttle plate to rotate said throttle plate within said cavity of said throttle body structure; and a rotational position sensor attached to said throttle body structure and operatively attached to said shaft of said throttle plate to determine a rotational position of said shaft.

17. A marine propulsion apparatus, comprising:

an internal combustion engine having an air intake chamber, said internal combustion engine comprising a crank shaft which is supported for rotation about a generally vertical axis;

a throttle body structure having a throttle plate supported for rotation within a cavity of said throttle body structure;

an elastomeric support member attached to said air intake chamber and to said throttle body structure to support said throttle body structure in non-contact association with said air intake chamber;

an isolator plate attached to said throttle body structure for the purpose of captivating a portion of said elastomeric support member between said isolator plate and said throttle body structure, said elastomeric support member having a sealing lip which extends between said isolator plate and said throttle body structure for the purpose of preventing air from flowing into said air intake chamber from between said isolator plate and said throttle body structure; and a motor attached to said throttle body structure, said motor being operatively attached to a shaft of said throttle plate to rotate said throttle plate within said cavity of said throttle body structure; and a rotational position sensor attached to said throttle body structure and operatively attached to said shaft of said throttle plate to determine a rotational position of said shaft.

18. The apparatus of claim 17, further comprising:

an adapter plate attached between said internal combustion engine and said elastomeric support member, said elastomeric support member being attached to said adapter plate by a ring which surrounds portions of said adapter plate and portions of said elastomeric support member, said cavity of said throttle body structure being generally cylindrical and said sealing lip being disposed in a plane which is generally perpendicular to a central axis of said generally cylindrical cavity.

19. The apparatus of claim 18, further comprising:

a sealing protrusion extending from said elastomeric support structure in a direction toward said throttle body structure and into a generally circular groove formed in said throttle body structure, said sealing protrusion being generally cylindrical and coaxial with said cavity, said sealing protrusion being compressible within said groove in response to said isolator plate being rigidly attached to said throttle body structure.

* * * * *